US011289254B2

(12) United States Patent
Nakamura

(10) Patent No.: US 11,289,254 B2
(45) **Date of Patent: *Mar. 29, 2022**

(54) INSULATOR-COATED SOFT MAGNETIC POWDER, POWDER MAGNETIC CORE, MAGNETIC ELEMENT, ELECTRONIC DEVICE, AND VEHICLE

(71) Applicant: Seiko Epson Corporation, Tokyo (JP)

(72) Inventor: Atsushi Nakamura, Hachinohe (JP)

(73) Assignee: Seiko Epson Corporation

( * ) Notice: Subject to any disclaimer, the term of this patent is extended or adjusted under 35 U.S.C. 154(b) by 295 days.

This patent is subject to a terminal disclaimer.

(21) Appl. No.: 16/395,331

(22) Filed: Apr. 26, 2019

(65) Prior Publication Data

US 2019/0333666 A1 Oct. 31, 2019

(30) Foreign Application Priority Data

Apr. 27, 2018 (JP) ..... JP2018-087063

(51) Int. Cl.

| | |
|---|---|
| ***H01F 7/02*** | (2006.01) |
| ***H01F 3/08*** | (2006.01) |
| ***H01F 1/24*** | (2006.01) |
| ***H01F 1/33*** | (2006.01) |
| ***H01F 1/147*** | (2006.01) |

(52) U.S. Cl.

CPC ..... *H01F 7/021* (2013.01); *H01F 1/14766* (2013.01); *H01F 1/14791* (2013.01); *H01F 1/24* (2013.01); *H01F 1/33* (2013.01); *H01F 3/08* (2013.01)

(58) Field of Classification Search

CPC ..... H01F 1/24; H01F 1/33; H01F 1/14766; H01F 1/14791; H01F 3/08

See application file for complete search history.

(56) References Cited

U.S. PATENT DOCUMENTS

| | | | | |
|---|---|---|---|---|
| 5,348,800 | A * | 9/1994 | Moro | H01F 1/33 252/62.58 |
| 5,756,162 | A | 5/1998 | Bae et al. | |
| 2009/0007418 | A1 | 1/2009 | Edo et al. | |
| 2012/0001719 | A1 | 1/2012 | Oshima et al. | |
| 2014/0138570 | A1 | 5/2014 | Otsuka et al. | |
| 2016/0240294 | A1 | 8/2016 | Inagaki et al. | |

(Continued)

FOREIGN PATENT DOCUMENTS

| | | |
|---|---|---|
| CN | 105355356 A | 2/2016 |
| CN | 106852099 A | 6/2017 |

(Continued)

*Primary Examiner* — C Melissa Koslow

(74) *Attorney, Agent, or Firm* — Harness, Dickey & Pierce, P.L.C.

(57) ABSTRACT

An insulator-coated soft magnetic powder includes a core particle including a base portion containing a soft magnetic material and an oxide film that is provided on a surface of the base portion and that contains an oxide of an element contained in the soft magnetic material, and an insulating particle that is provided on a surface of the core particle and that has an insulating property, wherein an average particle diameter after heat treatment after being subjected to a heat treatment of heating at 1000° C. is 90% or more and 110% or less of an average particle diameter before heat treatment before being subjected to the heat treatment.

14 Claims, 10 Drawing Sheets

(56) References Cited

U.S. PATENT DOCUMENTS

| | | | |
|---|---|---|---|
| 2017/0063172 | A1 | 3/2017 | Shiohara et al. |
| 2017/0155288 | A1 | 6/2017 | Lee et al. |
| 2017/0162307 | A1 | 6/2017 | Ishida |

FOREIGN PATENT DOCUMENTS

| | | | | |
|---|---|---|---|---|
| JP | S58-135172 | A | | 8/1983 |
| JP | H05-109520 | A | | 4/1993 |
| JP | H09-125108 | A | | 5/1997 |
| JP | 2001-307914 | | * | 11/2001 |
| JP | 2001-307914 | A | | 11/2001 |
| JP | 2003-068550 | A | | 3/2003 |
| JP | 2008-004864 | A | | 1/2008 |
| JP | 2009-188270 | A | | 8/2009 |
| JP | 2010-236018 | A | | 10/2010 |
| JP | 2012-129217 | A | | 7/2012 |
| JP | 2012-230948 | A | | 11/2012 |

* cited by examiner

INSULATOR-COATED SOFT MAGNETIC POWDER, POWDER MAGNETIC CORE, MAGNETIC ELEMENT, ELECTRONIC DEVICE, AND VEHICLE

The present application is based on and claims priority from JP Application Serial Number 2018-087063, filed Apr. 27, 2018, the disclosure of which is hereby incorporated by reference herein in its entirety.

BACKGROUND

1. Technical Field

The present invention relates to an insulator-coated soft magnetic powder, a powder magnetic core, a magnetic element, an electronic device, and a vehicle.

2. Related Art

Recently, reduction in size and weight of mobile devices such as notebook personal computers has advanced. However, in order to achieve both reduction in size and enhancement of performance at the same time, it is necessary to increase the frequency of a switched-mode power supply. At present, the driving frequency of a switched-mode power supply has been increased to several hundred kilohertz or more. However, accompanying this, a magnetic element such as a choke coil or an inductor built in a mobile device also needs to cope with the increase in the frequency.

However, if the driving frequency of such a magnetic element is increased, there arises a problem that the Joule loss due to an eddy current (eddy current loss) is significantly increased in a magnetic core included in each magnetic element. Therefore, particles of a soft magnetic powder contained in the magnetic core are insulated from each other so as to reduce the eddy current loss.

For example, JP-A-2009-188270 (Patent Document 1) discloses a soft magnetic metal particle powder in which an insulating layer provided on a surface of a particle is composed of oxide fine particles of aluminum or the like. Further, Patent Document 1 discloses that such a soft magnetic metal particle powder is produced by allowing mechanical energy composed of a compression and shear force to act on the oxide fine particles.

Recently, it has been demanded that strain remaining in a soft magnetic powder be more reliably removed by performing a heat treatment at a particularly high temperature (for example, a sintering temperature or higher). By doing this, coercive force is decreased, and thereby the hysteresis loss is reduced.

However, even in a soft magnetic metal particle powder as described in Patent Document 1, aggregation between metal particles may sometimes proceed in a heat treatment at a particularly high temperature exceeding their sintering temperature. When such aggregation occurs, characteristics as a powder are degraded, and therefore, moldability of the soft magnetic metal particle powder is deteriorated. Therefore, when the powder is subjected to powder compaction, a sufficient packing property is not obtained, and magnetic properties of the resulting powder magnetic core are deteriorated.

SUMMARY

The present disclosure can be implemented as the following application example.

An insulator-coated soft magnetic powder according to an application example of the present disclosure includes a core particle including a base portion containing a soft magnetic material and an oxide film that is provided on a surface of the base portion and contains an oxide of an element contained in the soft magnetic material, and an insulating particle that is provided on a surface of the core particle and has an insulating property, wherein an average particle diameter after heat treatment after being subjected to a heat treatment of heating at 1000° C. is 90% or more and 110% or less of an average particle diameter before heat treatment before being subjected to the heat treatment.

DESCRIPTION OF EXEMPLARY EMBODIMENTS

Hereinafter, an insulator-coated soft magnetic powder, a powder magnetic core, a magnetic element, an electronic device, and a vehicle according to the present disclosure will be described in detail based on preferred embodiments shown in the accompanying drawings.

Insulator-Coated Soft Magnetic Powder

First, an insulator-coated soft magnetic powder according to this embodiment will be described.

Figure 1:
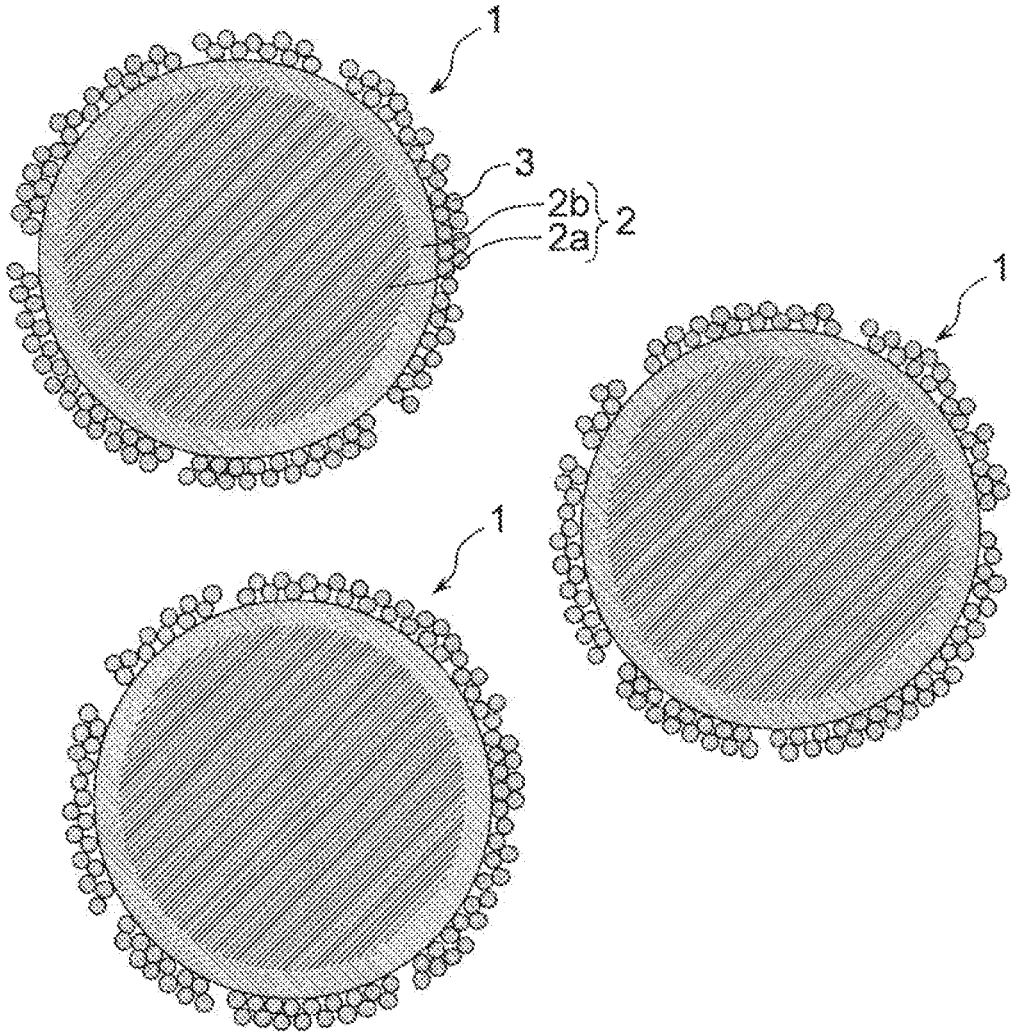
FIG. 1 is a cross-sectional view showing one particle of an embodiment of an insulator-coated soft magnetic powder according to the present disclosure.

FIG. 1 is a cross-sectional view showing one particle of an embodiment of an insulator-coated soft magnetic powder according to the present disclosure. In the following description, one particle of an insulator-coated soft magnetic powder is also referred to as "insulator-coated soft magnetic particle".

An insulator-coated soft magnetic particle 1 shown in FIG. 1 includes a core particle 2 including a base portion 2*a* containing a soft magnetic material and an oxide film 2*b* provided on a surface of the base portion 2*a*, and an insulating particle 3 that is provided on a surface of the core particle 2 and that has an insulating property. The oxide film 2*b* contains an oxide of an element contained in the soft magnetic material. Further, the insulator-coated soft magnetic particle 1 satisfies a relationship that an average particle diameter after heat treatment after being subjected to a heat treatment of heating at 1000° C. is 90% or more and 110% or less of an average particle diameter before heat treatment before being subjected to the heat treatment.

In such an insulator-coated soft magnetic particle 1, first, by providing the insulating particles 3 on the surface of the core particle 2, an insulating property between particles is ensured. Therefore, by molding such insulator-coated soft magnetic particles 1 into a predetermined shape, a powder magnetic core capable of realizing a magnetic element having small eddy current loss can be produced.

In particular, by the presence of the insulating particles 3 on the surfaces of the insulator-coated soft magnetic particles 1, the contact between the core particles 2 is more reliably suppressed. According to this, the insulation resistance between the core particles 2 is ensured, and the eddy current loss can be reduced.

Further, such insulator-coated soft magnetic particles 1 are configured such that the ratio of the average particle diameter after heat treatment after being subjected to a heat treatment at 1000° C. to the average particle diameter before heat treatment before being subjected to the heat treatment falls within the above-mentioned range. That is, the insulator-coated soft magnetic particles 1 are less likely to cause aggregation, adhesion, or the like between particles even if being subjected to a heat treatment at a high temperature by interposing the insulating particles 3 between the core particles 2. Therefore, even after being subjected to a heat treatment, the particles have an average particle diameter equivalent to that before the heat treatment, and a favorable packing property in powder compaction is obtained. As a result, the insulator-coated soft magnetic particles 1 show good handleability as a powder even after being subjected to a heat treatment at a high temperature and can produce a green compact having favorable magnetic properties.

Further, such insulator-coated soft magnetic particles 1 have high high-temperature resistance, and therefore, for example, a powder magnetic core and a magnetic element having high reliability at a high temperature can be realized. Due to this, such a powder magnetic core or a magnetic element can maintain excellent reliability even if it is used in an environment in which a high temperature is maintained over a long period of time, for example, as in an engine room.

Figure 2:
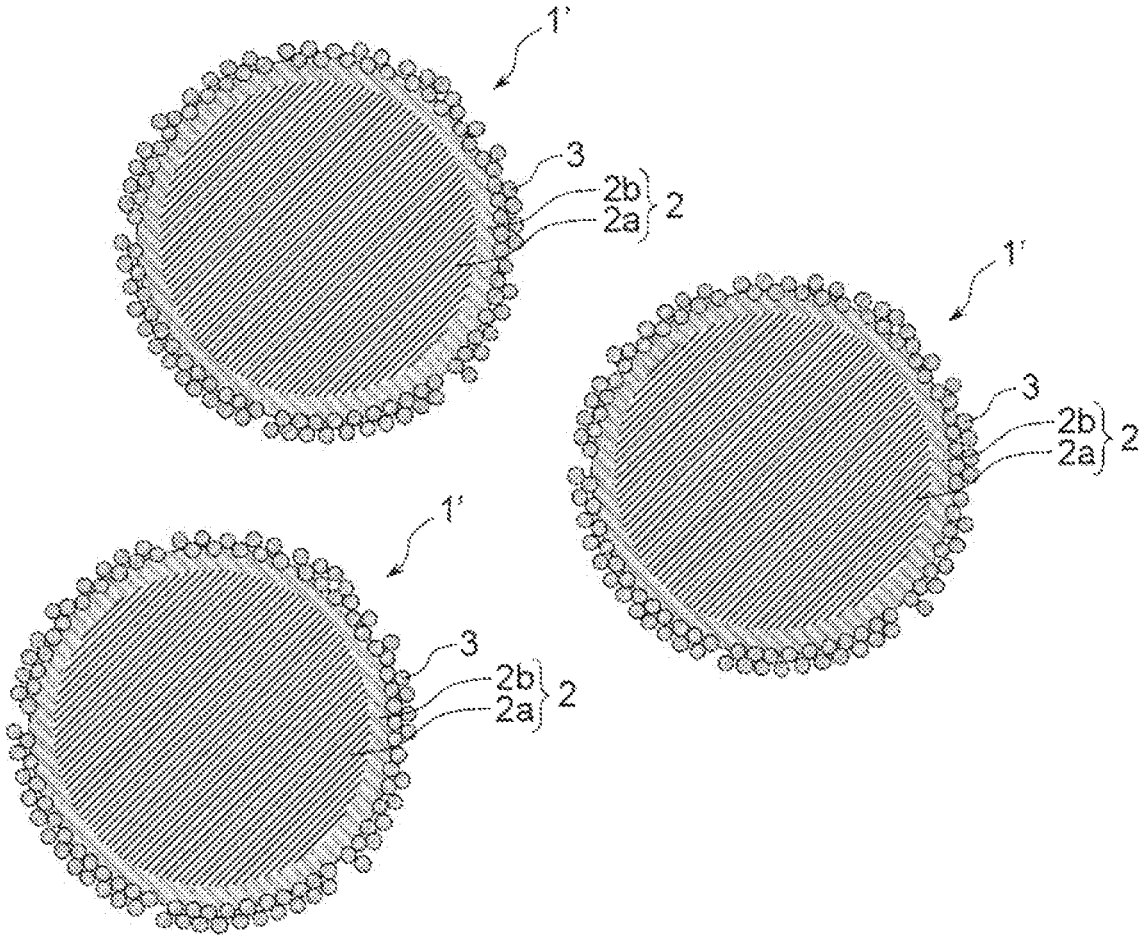
FIG. 2 is a cross-sectional view showing a modification of the insulator-coated soft magnetic particle shown in FIG. 1.

FIG. 2 is a cross-sectional view showing a modification of the insulator-coated soft magnetic particle shown in FIG. 1.

While the above-mentioned insulator-coated soft magnetic particle 1 shown in FIG. 1 is configured such that the insulating particles 3 are in contact with the surface of the core particle 2, an insulator-coated soft magnetic particle 1' shown in FIG. 2 is configured such that some of the insulating particles 3 are embedded in the surface of the core particle 2, specifically, in the below-mentioned oxide film 2*b*.

In such an insulator-coated soft magnetic particle 1', a wider contact area between the core particle 2 and the insulating particles 3 can be ensured. Therefore, a probability that the insulating particles 3 will fall off from the core particle 2 can be particularly decreased. As a result, the insulator-coated soft magnetic particles 1' that are particularly less likely to cause aggregation, adhesion, or the like between particles even if being subjected to a heat treatment at a high temperature are obtained.

Incidentally, among the plurality of insulating particles 3, while some may be embedded in the oxide film 2*b* as shown in FIG. 2, all may also be embedded in the oxide film 2*b*.

Further, as for one insulating particle 3, while a portion thereof may be embedded in the oxide film 2*b*, the entire portion thereof may also be embedded in the oxide film 2*b*.

Hereinafter, one example of a method for producing the insulator-coated soft magnetic particles 1 shown in FIG. 1 will be described in detail.

Such an example of the production method is a method for mechanically adhering insulating particles 3 having an insulating property to core particles 2. According to this, the insulating particles 3 are adhered to the surfaces of the core particles 2, whereby the above-mentioned insulator-coated soft magnetic particles 1 are obtained.

Figure 3:
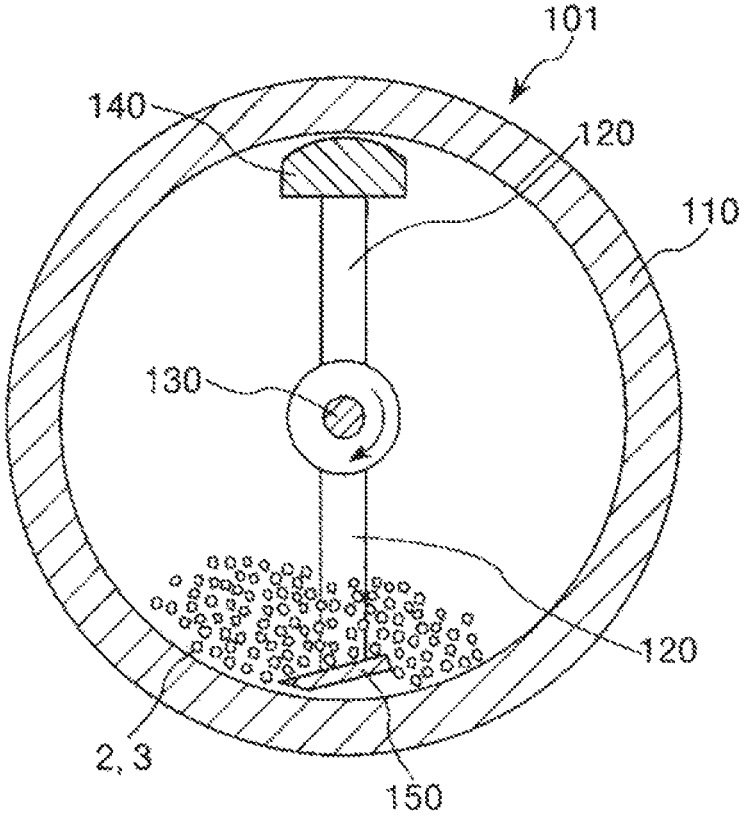
FIG. 3 is a longitudinal cross-sectional view showing a structure of a powder coating device.
Figure 4:
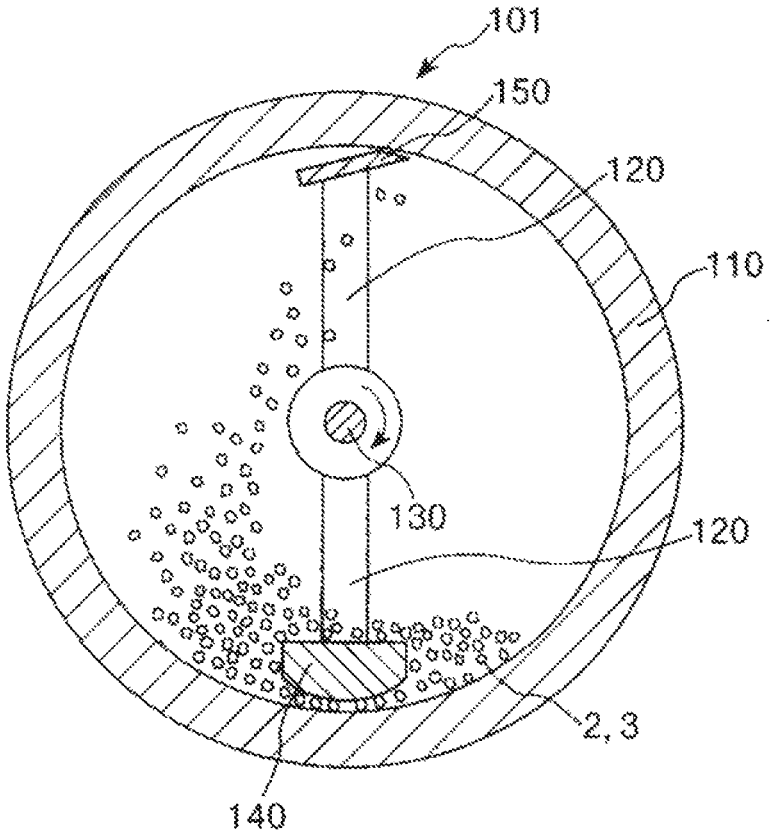
FIG. 4 is a longitudinal cross-sectional view showing a structure of the powder coating device.

FIGS. 3 and 4 are longitudinal cross-sectional views each showing a structure of a powder coating device.

[1] First, core particles 2 and insulating particles 3 are prepared (see FIG. 3).

The core particles 2 are particles containing a soft magnetic material.

Each of the core particles 2 according to this embodiment includes the base portion 2*a* containing the soft magnetic material and the oxide film 2*b* that is provided on a surface of the base portion 2*a* and that contains an oxide of an element contained in the soft magnetic material.

In such a core particle 2, the oxide film 2*b* having lower electrical conductivity than the core portion 2*a* is provided, and therefore, also in the core particle 2 itself, the insulation resistance between the core particles 2 is increased. According to this, in a green compact obtained by compacting the insulator-coated soft magnetic particles 1, the eddy current loss is further reduced.

Examples of the soft magnetic material contained in the base portion 2*a* include pure iron, various types of Fe-based alloys such as silicon steel (an Fe—Si-based alloy), permalloy (an Fe—Ni-based alloy), permendur (an Fe—Co-based alloy), an Fe—Si—Al-based alloy such as Sendust, an Fe—Cr—Si-based alloy, and an Fe—Cr—Al-based alloy, and other than these, various types of Ni-based alloys, and various types of Co-based alloys. Among these, various types of Fe-based alloys are preferably used from the viewpoint of magnetic properties such as magnetic permeability and magnetic flux density, and productivity such as cost.

A crystalline property of the soft magnetic material is not particularly limited, and the soft magnetic material may be crystalline or non-crystalline (amorphous) or microcrystalline (nanocrystalline).

The base portion 2*a* preferably contains the soft magnetic material as a main material, and may contain an impurity other than this.

The oxide contained in the oxide film 2*b* is an oxide of an element contained in the soft magnetic material contained in the base portion 2*a*. Therefore, when the soft magnetic material contained in the base portion 2*a* is, for example, an Fe—Cr—Si-based alloy, the oxide film 2*b* may contain at least one type of iron oxide, chromium oxide, and silicon oxide. The Fe—Cr—Si-based alloy sometimes contains an element (another element) other than the main element such as Fe, Cr, or Si. However, in such a case, the oxide film 2*b* may contain an oxide of another element in place of the oxide of the main element, or may contain both the oxide of the main element and the oxide of other element.

Examples of the oxide contained in the oxide film 2*b* include iron oxide, chromium oxide, nickel oxide, cobalt oxide, manganese oxide, silicon oxide, boron oxide, phosphorus oxide, aluminum oxide, magnesium oxide, calcium oxide, zinc oxide, titanium oxide, vanadium oxide, and cerium oxide, and among these, one type or two or more types are contained.

Among these the oxide film 2*b* preferably contains a glass forming component or a glass stabilizing component. According to this, for example, when the insulating particle 3 contains an oxide, the oxide film 2*b* acts to promote the adhesion of the insulating particle 3 to the oxide film 2*b*. That is, the glass forming component or the glass stabilizing component generates an interaction such as vitrification between the component and the oxide contained in the insulating particle 3 and promotes the adhesion of the insulating particle 3 so as to more firmly adhere to the oxide film 2*b*. As a result, the insulating particle 3 is less likely to fall off from the surface of the core particle 2, and thus, the insulator-coated soft magnetic particle 1 that hardly deteriorates its insulating property and therefore has high reliability is obtained.

Further, by vitrification, for example, even in an environment in which high temperature and low temperature are repeated, a gap is hardly generated between the core particle 2 and the insulating particle 3. Therefore, for example, a decrease in the insulating property due to penetration of water or the like in a gap can be suppressed. Accordingly, the insulator-coated soft magnetic particle 1 having favorable high-temperature resistance is obtained also from this viewpoint.

In other words, the insulating particle 3 and the oxide film 2*b* are preferably combined into a composite. According to this, the core particle 2 and the insulating particle 3 are more firmly adhered to each other, and a decrease in the insulating property can be suppressed even at a high temperature.

The state of being combined into a composite refers to a state in which the insulating particle 3 is embedded in the oxide film 2*b* or a state in which a constituent component of the insulating particle 3 and a constituent component of the oxide film 2*b* are mutually diffused.

Examples of the glass forming component include silicon oxide, boron oxide, and phosphorus oxide.

On the other hand, examples of the glass stabilizing component include aluminum oxide.

Among these oxides, the oxide film 2*b* preferably contains at least one type of silicon oxide, aluminum oxide, and chromium oxide. Silicon oxide is the glass forming component and aluminum oxide is the glass stabilizing component, and therefore, such a component is likely to generate an interaction such as vitrification with the oxide contained in the insulating particle 3. Due to this, the insulating particle 3 is more firmly adhered to the oxide film 2*b*, and thus, the insulator-coated soft magnetic particle 1 that hardly deteriorates its insulating property and therefore has high reliability is obtained. Further, chromium oxide is chemically stable, and therefore, the insulator-coated soft magnetic particle 1 that hardly deteriorates its insulating property even at a high temperature and therefore has high reliability is obtained.

The presence or absence of the oxide film 2*b* can be determined according to the oxygen atom concentration distribution in a direction toward the center from the surface of the core particle 2 (hereinafter referred to as "depth direction"). That is, when the oxygen atom concentration distribution in the depth direction of the core particle 2 is obtained, the presence or absence of the oxide film 2*b* can be evaluated according to the distribution.

Such a concentration distribution can be obtained by, for example, a depth direction analysis using Auger electron spectroscopy in combination with sputtering. In this analysis, the core particle 2 is irradiated with an electron beam while allowing ions to collide with the surface of the core particle 2 so as to gradually peel off an atomic layer, and an atom is identified and quantitatively determined based on the kinetic energy of an Auger electron emitted from the core particle 2. Therefore, by converting a time required for the sputtering into a thickness of the atomic layer peeled off by the sputtering, a relationship between the depth from the surface of the core particle 2 and the compositional ratio can be determined.

A position at a depth of 300 nm from the surface of the core particle 2 can be regarded as sufficiently deep from the surface, and therefore, the oxygen concentration at that position can be regarded as an internal oxygen concentration of the core particle 2.

In that case, by calculating a relative amount with respect to the internal oxygen concentration from the oxygen concentration distribution in the depth direction from the surface of the core particle 2, a thickness of the oxide film 2*b* can be calculated. Specifically, in the core particle 2, oxidation proceeds inward from the surface in the production process, however, if the oxygen concentration obtained by the above-mentioned analysis is within the range of ±50% of the internal oxygen concentration, the oxide film 2*b* can be regarded as not being present in the place where the analysis is performed. On the other hand, if the oxygen concentration obtained by the above-mentioned analysis is higher than +50% of the internal oxygen concentration, the oxide film 2*b* can be regarded as being present in the place where the analysis is performed.

Therefore, by repeating such evaluation, the thickness of the oxide film 2*b* can be determined.

The type of the oxide contained in the oxide film 2*b* can be identified by, for example, X-ray photoelectron spectroscopy or the like.

The thickness of the oxide film 2*b* measured in this manner is preferably 5 nm or more and 200 nm or less, and more preferably 10 nm or more and 100 nm or less. According to this, the core particle 2 itself also has an insulating property. Therefore, the insulator-coated soft magnetic particle 1 having a higher insulating property is obtained in cooperation with the insulating particle 3.

Further, according to the oxide film 2*b* having such a thickness, the adhesion strength between the oxide film 2*b* and the insulating particle 3 can be further enhanced. Accordingly, the insulating particle 3 is much less likely to fall off from the surface of the core particle 2, and thus, the reliability of the insulator-coated soft magnetic particle 1 can be further improved.

When the thickness of the oxide film 2*b* is less than the above-mentioned lower limit, since the thickness of the oxide film 2*b* is thin, the insulating property between the insulator-coated soft magnetic particles 1 may be deteriorated, or the insulating particle 3 may be more likely to fall off from the oxide film 2*b*. On the other hand, when the thickness of the oxide film 2*b* is more than the above-mentioned upper limit, since the thickness of the oxide film 2*b* is too thick, the volume of the base portion 2*a* is relatively decreased, and therefore, the magnetic properties of a green compact obtained by compacting the insulator-coated soft magnetic particles 1 may be deteriorated.

Such core particles 2 may be produced by any method, but is produced by, for example, any of various types of powdering methods such as an atomization method (for example, a water atomization method, a gas atomization method, a spinning water atomization method, etc.), a reducing method, a carbonyl method, and a pulverization method.

Among these, as the core particles 2, core particles produced by a water atomization method or a spinning water atomization method are preferably used. By using a water atomization method and a spinning water atomization method, an extremely fine powder can be efficiently produced. Further, in the water atomization method and the spinning water atomization method, powdering is performed by utilizing contact between a molten metal and water, and therefore, the oxide film 2*b* having a moderate film thickness is formed on the surface of the core particle 2. As a result, the core particle 2 including the oxide film 2*b* having a moderate film thickness can be efficiently produced.

The thickness of the oxide film 2*b* can be adjusted by, for example, a cooling rate of a molten metal when producing the core particle 2. Specifically, by decreasing the cooling rate, the thickness of the oxide film 2*b* can be increased.

The insulating particle 3 is a particle containing an insulating material.

Examples of the insulating material include various types of ceramic materials. Specific examples thereof include aluminum oxide, magnesium oxide, titanium oxide, zirconium oxide, silicon oxide, iron oxide, potassium oxide, sodium oxide, calcium oxide, chromium oxide, boron nitride, silicon nitride, and silicon carbide, and a material containing one type or two or more types among these is used.

The insulating particle 3 preferably contains at least one type of aluminum oxide, silicon oxide, zirconium oxide, and silicon nitride among these. These have a relatively high hardness and a relatively high softening point (melting point). Therefore, the insulator-coated soft magnetic particles 1 including such insulating particles 3 easily maintain the particulate shape of the insulating particle 3 even when a compression load is applied. Due to this, the insulator-coated soft magnetic particles 1 that hardly deteriorate the insulating property between particles even when being compacted, can be subjected to powder compaction at a high pressure, and thus can produce a green compact having favorable magnetic properties are obtained. Further, the insulator-coated soft magnetic particles 1 including such insulating particles 3 have high heat resistance. Therefore, the insulator-coated soft magnetic particles 1 that have a small change in the average particle diameter and hardly deteriorate the powder properties such as a packing property in a molding die even if the particles are subjected to a heat treatment at a high temperature can be realized.

As the insulating material, a material having a relatively high hardness is preferably used. Specifically, a material having a Mohs hardness of 6 or more is preferred, and a material having a Mohs hardness of 6.5 or more and 9.5 or less is more preferred. According to such an insulating material, the particulate shape of the insulating particle 3 is easily maintained even when a compression load is applied. Therefore, the insulator-coated soft magnetic particles 1 that hardly deteriorate the insulating property between particles even when being compacted, can be subjected to powder compaction at a high pressure, and thus can produce a green compact having favorable magnetic properties are obtained.

The insulating material having such a Mohs hardness has a relatively high melting point, and therefore has high heat resistance. Therefore, the insulator-coated soft magnetic particles 1 that have a small change in the average particle diameter and hardly deteriorate the powder properties such as a packing property in a molding die even if the particles are subjected to a heat treatment at a high temperature can be realized.

The average particle diameter of the insulating particles 3 is not particularly limited, but is preferably 1 nm or more and 500 nm or less, more preferably 5 nm or more and 300 nm or less, and further more preferably 8 nm or more and 100 nm or less. By setting the average particle diameter of the insulating particles 3 within the above range, when the insulating particles 3 are mechanically adhered to the core particles 2 in the below-mentioned step, a necessary and sufficient magnitude of pressure can be applied to the insulating particles 3. As a result, the insulating particles 3 can be favorably closely adhered to the core particles 2.

The average particle diameter of the insulating particles 3 is a particle diameter when the cumulative frequency from the small diameter side reaches 50% in the mass-based cumulative distribution obtained by a laser diffraction particle size distribution analyzer.

Further, the average particle diameter of the insulating particles 3 is preferably about 0.01% or more and 10.0% or less, and more preferably about 0.05% or more and 5.0% or less of the average particle diameter of the core particles 2. When the average particle diameter of the insulating particles 3 is within the above range, the insulator-coated soft magnetic particles 1 have a sufficient insulating property, and when a powder magnetic core is produced by pressing and molding an aggregate of the insulator-coated soft magnetic particles 1, a significant decrease in the occupancy of the core particles 2 in the powder magnetic core is prevented. As a result, the insulator-coated soft magnetic particles 1 capable of producing a powder magnetic core having small eddy current loss and excellent magnetic properties such as magnetic permeability and magnetic flux density are obtained.

The average particle diameter of the core particles 2 is preferably 1 μm or more and 50 μm or less, more preferably 2 μm or more and 30 μm or less, and further more preferably 3 μm or more and 15 μm or less. When the average particle diameter of the core particles 2 is within the above range, the insulator-coated soft magnetic particles 1 capable of producing a powder magnetic core having small eddy current loss and excellent magnetic properties such as magnetic permeability and magnetic flux density are obtained.

An addition amount of the insulating particles 3 is preferably 0.1 mass % or more and 5 mass % or less, and more preferably 0.3 mass % or more and 3 mass % or less of the amount of the core particles 2. When the addition amount of the insulating particles 3 is within the above range, the insulator-coated soft magnetic particles 1 have a sufficient insulating property, and when a powder magnetic core is produced by pressing and molding an aggregate of the insulator-coated soft magnetic particles 1, a significant decrease in the occupancy of the core particles 2 in the powder magnetic core is prevented. As a result, the insulator-coated soft magnetic particles 1 capable of producing a powder magnetic core having small eddy current loss and excellent magnetic properties such as magnetic permeability and magnetic flux density are obtained.

[2] Subsequently, the insulating particles 3 are mechanically adhered to the core particles 2. By doing this, the insulator-coated soft magnetic particles 1 are obtained.

This mechanical adhesion is caused by pressing the insulating particles 3 against the surfaces of the core particles 2 at a high pressure. Specifically, the insulator-coated soft magnetic particles 1 are produced by causing the above-mentioned mechanical adhesion using a powder coating device 101 as shown in FIGS. 3 and 4.

Examples of a device that causes mechanical compression and friction actions on the core particles 2 and the insulating particles 3 include various types of pulverizers such as a hammer mill, a disk mill, a roller mill, a ball mill, a planetary mill, and a jet mill, and various types of friction mixers such as Angmill (registered trademark), a high-speed oval mixer, a Mix Muller (registered trademark), a Jacobson mill, Mechanofusion (registered trademark), and Hybridization (registered trademark). Here, as one example, the powder coating device 101 (friction mixer) shown in FIGS. 3 and 4 including a container 110 and a chip 140 that rotates inside the container along an inner wall of the container will be described.

The powder coating device 101 includes the container 110 having a cylindrical shape and an arm 120 having a rod-like shape provided inside the container 110 along its radial axis.

The container 110 is constituted by a metal material such as stainless steel, and mechanical compression and friction actions are given to a mixture of the core particles 2 and the insulating particles 3 fed into the container.

At the center in the longitudinal axis of the arm 120, a rotating shaft 130 is inserted, and the arm 120 is rotatably provided with this rotating shaft 130 as a center of rotation. The rotating shaft 130 is provided so as to coincide with a central axis of the container 110.

In one end portion of the arm 120, the chip 140 is provided. This chip 140 has a shape with a convex curved plane and a flat plane facing the curved plane, and the curved plane faces the inner wall of the container 110, and a separation distance between this curved plane and the container 110 is set to a predetermined length. According to this, the chip 140 rotates along the inner wall of the container 110 with the rotation of the arm 120 while maintaining a constant distance from the inner wall.

In the other end portion of the arm 120, a scraper 150 is provided. This scraper 150 is a plate-like member, and in the same manner as the chip 140, a separation distance between the scraper 150 and the container 110 is set to a predetermined length. According to this, the scraper 150 can scrape materials near the inner wall of the container 110 with the rotation of the arm 120.

The rotating shaft 130 is coupled to a rotation driving device (not shown) provided outside the container 110 and thus can rotate the arm 120.

The container 110 can maintain a sealed state while driving the powder coating device 101 and can maintain the inside in a reduced pressure (vacuum) state or a state of being replaced with any of various types of gases. The gas inside the container 110 is preferably replaced with an inert gas such as nitrogen or argon.

Next, a method for producing the insulator-coated soft magnetic particles 1 using the powder coating device 101 will be described.

First, the core particles 2 and the insulating particles 3 are fed into the container 110. Subsequently, the container 110 is sealed and the arm 120 is rotated.

Here, FIG. 3 shows a state of the powder coating device 101 when the chip 140 is located on its upper side and the scraper 150 is located on its lower side, and on the other hand, FIG. 4 shows a state of the powder coating device 101 when the chip 140 is located on its lower side and the scraper 150 is located on its upper side.

The core particles 2 and the insulating particles 3 are scraped as shown in FIG. 3 by the scraper 150. According to this, the core particles 2 and the insulating particles 3 are lifted up with the rotation of the arm 120 and thereafter fall down, and thus are stirred.

On the other hand, as shown in FIG. 4, when the chip 140 descends, the core particles 2 and the insulating particles 3 penetrate into a space between the chip 140 and the container 110 and are subjected to a compression action and a friction action from the chip 140 with the rotation of the arm 120.

By repeating the stirring and the compression and friction actions at a high speed, the insulating particles 3 are adhered to the surfaces of the core particles 2.

A rotation rate of the arm 120 slightly varies depending on the amount of the powder to be fed into the container 110, but is preferably set to about 300 to 1200 rotations per minute.

The pressing force when the chip 140 compresses the powder varies depending on the size of the chip 140, but is preferably, for example, about 30 to 500 N.

The adhesion of the insulating particles 3 as described above can be performed under a dry condition unlike a coating method using an aqueous solution, and moreover can also be performed in an inert gas atmosphere. Therefore, there is no fear that water or the like is interposed between the core particle 2 and the insulating particle 3 during the process, and thus, the long-term durability of the insulator-coated soft magnetic particles 1 can be enhanced.

The insulating particles 3 may be subjected to a surface treatment as needed. Examples of the surface treatment include a hydrophobic treatment. By performing a hydrophobic treatment, adsorption of water onto the insulating particles 3 can be suppressed. Therefore, deterioration or the like of the core particles 2 due to water can be suppressed. In addition, the hydrophobic treatment also has an effect of suppressing aggregation of the insulator-coated soft magnetic particles 1.

Examples of the hydrophobic treatment include trimethylsilylation and arylation (for example, phenylation). In the trimethylsilylation, for example, a trimethylsilylating agent such as trimethylchlorosilane or the like is used. In the arylation, for example, an arylating agent such as an aryl halide is used.

The thus obtained insulator-coated soft magnetic particles 1 satisfy a relationship that the average particle diameter after heat treatment after being subjected to a heat treatment at 1000° C. is 90% or more and 110% or less of the average particle diameter before heat treatment before being subjected to the heat treatment.

Such insulator-coated soft magnetic particles 1 have an average particle diameter equivalent to that before the heat treatment even after being subjected to a heat treatment as described above, and therefore show a favorable packing property even when being subjected to, for example, powder compaction. That is, since each of the core particles 2 includes the base portion 2*a* and the oxide film 2*b*, an interaction such as sintering between particles hardly occurs. Due to this, even if the insulator-coated soft magnetic particles 1 are subjected to powder compaction or the like, the insulator-coated soft magnetic particles 1 can be densely packed in every corner of a molding die. Therefore, the molded density is increased, and thus, a green compact having favorable magnetic properties such as magnetic permeability and magnetic flux density can be obtained.

Further, the insulator-coated soft magnetic particles 1 can be subjected to a heat treatment at a high temperature, and therefore, strain remaining in the insulator-coated soft magnetic particles 1 can be more reliably removed in a shorter time. According to this, a green compact having favorable magnetic properties such as magnetic permeability and coercive force can be efficiently produced.

Moreover, by applying a heat treatment at a high temperature before powder compaction, it is possible to obtain the insulator-coated soft magnetic particles 1 having an advantage that even when the particles are subjected to powder compaction thereafter, strain is less likely to occur, or even if strain occurs, the strain is easily removed by a simple heat treatment.

The heat treatment at 1000° C. is a treatment of heating the insulator-coated soft magnetic particles 1 at 1000° C. for 4 hours. Further, as a treatment atmosphere, a hydrogen atmosphere is adopted.

Further, the average particle diameter of the insulator-coated soft magnetic particles 1 after being subjected to the heat treatment at 1000° C., that is, the average particle diameter after heat treatment preferably satisfies a relationship that the average particle diameter after heat treatment is 92% or more and 108% or less, and more preferably 95% or more and 105% or less of the average particle diameter before being subjected to the heat treatment, that is, the average particle diameter before heat treatment.

When the ratio of the average particle diameter after heat treatment to the average particle diameter before heat treatment is lower than the above lower limit, the insulating particles 3 may fall off from the insulator-coated soft magnetic particles 1 so as to lower the average particle diameter by that amount. Therefore, the insulating property of the insulator-coated soft magnetic particles 1 may be deteriorated. On the other hand, when the ratio of the average particle diameter after heat treatment to the average particle diameter before heat treatment exceeds the above upper limit, the insulator-coated soft magnetic particles 1 may be sintered to one another so as to raise the average particle diameter by that amount. Therefore, when the insulator-coated soft magnetic particles 1 are subjected to powder compaction or the like, the packing property may be deteriorated. In such a case, the molded density is decreased, and the magnetic properties such as magnetic permeability and magnetic flux density of a green compact may be deteriorated.

The average particle diameter of the insulator-coated soft magnetic particles 1 is a particle diameter when a cumulative frequency from a small diameter side reaches 50% in a mass-based cumulative distribution obtained by a laser diffraction particle size distribution analyzer.

Such a relationship regarding the average particle diameters can be appropriately adjusted according to the particle diameters and amount of the core particles 2, the particle diameters and amount of the insulating particles 3, etc. For example, when the amount of the insulating particles 3 is increased, the average particle diameter after heat treatment tends not to change much with respect to the average particle diameter before heat treatment. Further, when the amount of the core particles 2 is increased, the average particle diameter after heat treatment tends to easily change with respect to the average particle diameter before heat treatment.

Further, for example, the average particle diameter of the insulator-coated soft magnetic particles 1 is preferably 1 μm or more and 50 μm or less, more preferably 2 μm or more and 30 μm or less, and further more preferably 3 μm or more and 15 μm or less. When the average particle diameter of the insulator-coated soft magnetic particles 1 is within the above range, the insulator-coated soft magnetic particles 1 can produce a powder magnetic core having small eddy current loss and excellent magnetic properties such as magnetic permeability and magnetic flux density.

The thus obtained insulator-coated soft magnetic particles 1 may be classified as needed. Examples of the classification method include dry classification such as sieve classification, inertial classification, and centrifugal classification, and wet classification such as sedimentation classification.

Further, before being fed into the powder coating device 101, the core particles 2 and the insulating particles 3 may be stirred (mixed) by a stirrer, a mixer, or the like.

The volume resistivity (specific electrical resistance) of the powder that is an aggregate of the insulator-coated soft magnetic particles 1 when the powder is packed in a container is preferably 1 [MΩ·cm] or more, more preferably 5 [MΩ·cm] or more and 1000 [GΩ·cm] or less, and further more preferably 10 [MΩ·cm] or more and 500 [GΩ·cm] or less. Such a volume resistivity is achieved without using an additional insulating material, and therefore is based on the insulating property between the insulator-coated soft magnetic particles 1 themselves. Therefore, when the insulator-coated soft magnetic particles 1 achieving such a volume resistivity are used, since the insulator-coated soft magnetic particles 1 are sufficiently insulated from each other, a usage amount of an additional insulating material can be reduced, and thus, a proportion of the insulator-coated soft magnetic particles 1 in a powder magnetic core or the like can be increased to the maximum by that amount. As a result, a powder magnetic core highly achieving both high magnetic properties and low loss can be realized. In addition, an electrical breakdown voltage of the powder magnetic core can be increased.

The volume resistivity described above is a value measured as follows.

First, 1 g of the insulator-coated soft magnetic powder to be measured is packed in a cylinder made of alumina. Then, electrodes made of brass are disposed on upper and lower sides of the cylinder.

Then, an electrical resistance between the upper and lower electrodes is measured using a digital multimeter while applying a pressure between the upper and lower electrodes at a load of 20 kgf using a digital force gauge.

Then, the volume resistivity is calculated by substituting the measured electrical resistance, a distance between the electrodes when applying the pressure, and an internal cross-sectional area of the cylinder into the following calculation formula.

Volume resistivity [MΩ·cm]=Electrical resistance [MΩ]×Internal cross-sectional area of cylinder [$cm^2$]/Distance between electrodes [cm]

The internal cross-sectional area of the cylinder can be obtained according to the formula: $\pi r^2$ [$cm^2$] when the inner diameter of the cylinder is represented by 2r (cm). In this measurement, the inner diameter of the cylinder is set to 0.8 [cm].

Further, the distance between the electrodes when applying the pressure is set to 0.425 [cm].

Particles having an insulating property other than the insulating particles 3 may be used together with the insulating particles 3.

Examples of the particles having an insulating property other than the insulating particles 3 include glass particles.

Examples of a component contained in the glass particles include $Bi_2O_3$, $B_2O_3$, $SiO_2$, $Al_2O_3$, ZnO, SnO, $P_2O_5$, PbO, $Li_2O$, $Na_2O$, $K_2O$, MgO, CaO, SrO, BaO, $Gd_2O_3$, $Y_2O_3$, $La_2O_3$, and $Yb_2O_3$, and among these, one type or two or more types are used.

Other than these, an electrically non-conductive inorganic material such as a silicon material may be used.

The addition amount of the particles having an insulating property other than the insulating particles 3 is preferably 50 mass % or less, and more preferably 30 mass % or less of the amount of the insulating particles 3.

A heat treatment is applied to the insulator-coated soft magnetic particles 1 obtained as described above. By applying the heat treatment, strain remaining in the insulator-coated soft magnetic particles 1 can be removed (annealed) as described above. According to this, for example, a powder magnetic core having favorable magnetic properties such as coercive force can be realized.

The temperature of the heat treatment is appropriately set according to the type of the soft magnetic material, but is preferably 600° C. or higher and 1200° C. or lower, and more preferably 800° C. or higher and 1100° C. or lower. By setting the temperature of the heat treatment within the above range, strain remaining in the insulator-coated soft magnetic particles 1 can be more reliably removed in a shorter time. According to this, a green compact having favorable magnetic properties can be efficiently produced.

Further, by applying a heat treatment at such a temperature before powder compaction, the insulator-coated soft magnetic particles 1 having an advantage that even when the particles are subjected to powder compaction thereafter, strain is less likely to occur, or even if strain occurs, the strain is easily removed by a simple heat treatment are obtained.

The time of the heat treatment is appropriately set according to the temperature of the heat treatment, but is preferably 30 minutes or more and 10 hours or less, and more preferably 1 hour or more and 6 hours or less. By setting the time of the heat treatment within the above range, strain remaining in the insulator-coated soft magnetic particles 1 can be sufficiently removed.

The atmosphere of the heat treatment is not particularly limited, and examples thereof include an oxidizing atmosphere containing oxygen, air, or the like, a reducing atmosphere containing hydrogen, an ammonia decomposition gas, or the like, an inert atmosphere containing nitrogen, argon, or the like, and a reduced pressure atmosphere obtained by reducing the pressure of an arbitrary gas, but it is preferably a reducing atmosphere, an inert atmosphere, or a reduced pressure atmosphere, and more preferably a reducing atmosphere. According to this, an annealing treatment can be performed while suppressing an increase in the thickness of the oxide film 2*b* of the core particle 2. As a result, the insulator-coated soft magnetic particles 1 having favorable magnetic properties and also achieving a high adhesion strength of the insulating particles 3 are obtained.

Powder Magnetic Core and Magnetic Element

Next, a powder magnetic core according to this embodiment and a magnetic element according to this embodiment will be described.

The magnetic element according to this embodiment can be applied to various types of magnetic elements including a magnetic core such as a choke coil, an inductor, a noise filter, a reactor, a transformer, a motor, an actuator, an antenna, an electromagnetic wave absorber, a solenoid valve, and an electrical generator. Further, the powder magnetic core according to this embodiment can be applied to the magnetic core included in these magnetic elements.

Hereinafter, as an example of the magnetic element, two types of choke coils will be described as representatives.

First Embodiment

First, a choke coil to which a magnetic element according to a first embodiment is applied will be described.

Figure 5:
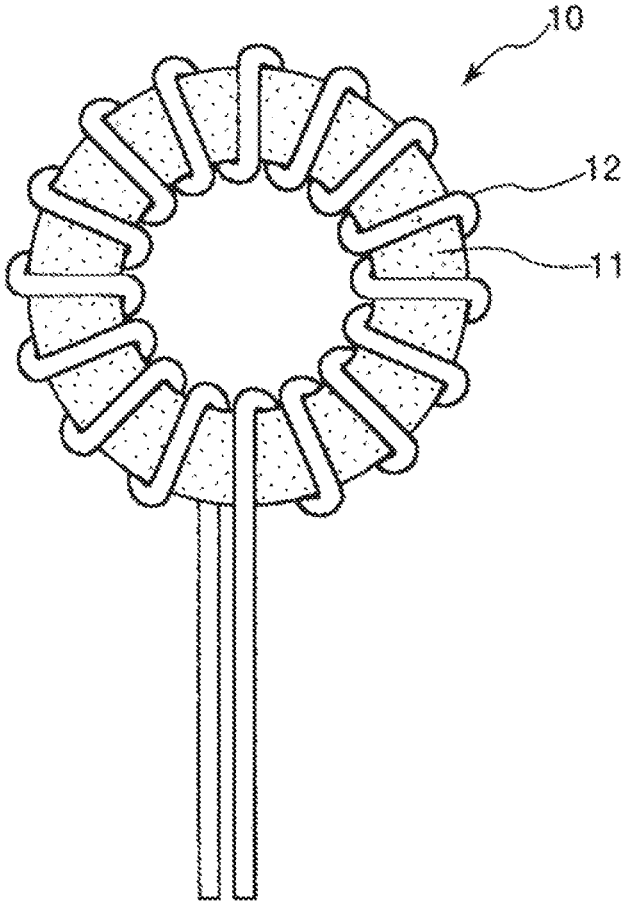
FIG. 5 is a schematic view (plan view) showing a choke coil to which a magnetic element according to a first embodiment is applied.

FIG. 5 is a schematic view (plan view) showing the choke coil to which the magnetic element according to the first embodiment is applied.

A choke coil 10 shown in FIG. 5 includes a powder magnetic core 11 having a ring shape (toroidal shape) and a conductive wire 12 wound around the powder magnetic core 11. Such a choke coil 10 is generally referred to as "toroidal coil".

The powder magnetic core 11 is obtained by mixing the insulator-coated soft magnetic powder including the insulator-coated soft magnetic particles 1 described above, a binding material (binder), and an organic solvent, supplying the obtained mixture in a molding die, and press molding the mixture. That is, the powder magnetic core 11 includes the insulator-coated soft magnetic powder according to this embodiment. Such a powder magnetic core 11 has a favorable insulating property between particles and favorable heat resistance, and therefore has small eddy current loss even at a high temperature. Further, by undergoing the heat treatment at a high temperature, a coercive force of the insulator-coated soft magnetic powder can be decreased, and therefore, a hysteresis loss is reduced. As a result, reduction of a transmission loss (improvement of the magnetic properties) of the powder magnetic core 11 is achieved, and when the powder magnetic core 11 is mounted on an electronic device or the like, the power consumption of the electronic device or the like can be reduced or the performance thereof can be enhanced, and thus, it can contribute to the improvement of the reliability of the electronic device or the like at a high temperature.

Further, as described above, the choke coil 10 that is one example of the magnetic element includes the powder magnetic core 11. Therefore, the choke coil 10 has enhanced performance and reduced iron loss. As a result, when the choke coil 10 is mounted on an electronic device or the like, the power consumption of the electronic device or the like can be reduced or the performance thereof can be enhanced, and it can contribute to the improvement of reliability at a high temperature of the electronic device or the like.

Examples of the constituent material of the binding material to be used for producing the powder magnetic core 11 include organic materials such as a silicone-based resin, an epoxy-based resin, a phenolic resin, a polyamide-based resin, a polyimide-based resin, and a polyphenylene sulfide-based resin, and inorganic materials such as phosphates such as magnesium phosphate, calcium phosphate, zinc phosphate, manganese phosphate, and cadmium phosphate, and silicates (liquid glass) such as sodium silicate, and particularly, a thermosetting polyimide-based resin or a thermosetting epoxy-based resin is preferred. These resin materials are easily cured by heating and have excellent heat resistance. Therefore, the ease of production and the heat resistance of the powder magnetic core 11 can be enhanced.

The binding material may be used according to need and may be omitted. Even in such a case, in the insulator-coated soft magnetic powder, insulation between particles is achieved, and therefore, the occurrence of loss accompanying the conduction of electricity between particles can be suppressed.

A ratio of the binding material to the insulator-coated soft magnetic powder slightly varies depending on the desired saturation magnetic flux density or mechanical properties, the allowable eddy current loss, etc. of the powder magnetic core 11 to be produced, but is preferably about 0.5 mass % or more and 5.0 mass % or less, and more preferably about 1.0 mass % or more and 3.0 mass % or less. According to this, the powder magnetic core 11 having excellent magnetic properties such as saturation magnetic flux density and magnetic permeability can be obtained while sufficiently binding the particles of the insulator-coated soft magnetic powder.

The organic solvent is not particularly limited as long as it can dissolve the binding material, but examples thereof include various types of solvents such as toluene, isopropyl alcohol, acetone, methyl ethyl ketone, chloroform, and ethyl acetate.

In the above-mentioned mixture, any of various types of additives may be added for an arbitrary purpose as needed.

On the other hand, examples of the constituent material of the conductive wire 12 include materials having high electrical conductivity, for example, metal materials including Cu, Al, Ag, Au, Ni, and the like.

It is preferred that on a surface of the conductive wire 12, a surface layer having an insulating property is provided. According to this, a short circuit between the powder magnetic core 11 and the conductive wire 12 can be reliably prevented. Examples of the constituent material of such a surface layer include various types of resin materials.

Next, a method for producing the choke coil 10 will be described.

First, the insulator-coated soft magnetic powder, a binding material, all sorts of necessary additives, and an organic solvent are mixed, whereby a mixture is obtained.

Subsequently, the mixture is dried to obtain a block-shaped dry material. Then, this dried material is pulverized, whereby a granulated powder is formed.

Subsequently, this granulated powder is molded into a shape of a powder magnetic core to be produced, whereby a molded body is obtained.

A molding method in this case is not particularly limited, however, examples thereof include press molding, extrusion molding, and injection molding methods. The shape and size of this molded body are determined in anticipation of shrinkage when heating the molded body in the subsequent step. Further, the molding pressure in a case of press molding is set to about 1 t/cm$^2$ (98 MPa) or more and 10 t/cm$^2$ (981 MPa) or less.

Subsequently, by heating the obtained molded body, the binding material is cured, whereby the powder magnetic core 11 is obtained. The heating temperature at that time slightly varies depending on the composition of the binding material or the like, however, when the binding material is composed of an organic material, the heating temperature is set to preferably about 100° C. or higher and 500° C. or lower, and more preferably about 120° C. or higher and 250° C. or lower. Further, the heating time varies depending on the heating temperature, but is set to about 0.5 hours or more and 5.0 hours or less.

As described above, the powder magnetic core 11 formed by press molding the insulator-coated soft magnetic powder according to this embodiment and the choke coil 10 formed by winding the conductive wire 12 around the powder magnetic core 11 along the outer circumferential surface thereof are obtained.

The shape of the powder magnetic core 11 is not limited to the ring shape shown in FIG. 5, and may be, for example, a shape in which part of a ring is missing or may be a rod-like shape.

The powder magnetic core 11 may contain a soft magnetic powder other than the insulator-coated soft magnetic powder according to the above-mentioned embodiment as needed. In that case, a mixing ratio of the insulator-coated soft magnetic powder according to the embodiment and the other soft magnetic powder is not particularly limited and is arbitrarily set. Further, as the other soft magnetic powder, two or more types may be used.

Second Embodiment

Next, a choke coil to which a magnetic element according to a second embodiment is applied will be described.

Figure 6:
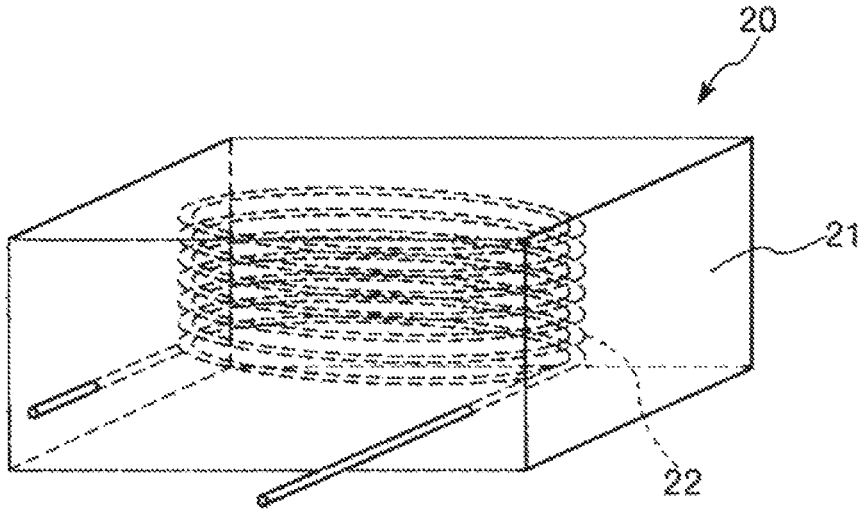
FIG. 6 is a schematic view (transparent perspective view) showing a choke coil to which a magnetic element according to a second embodiment is applied.

FIG. 6 is a schematic view (transparent perspective view) showing the choke coil to which the magnetic element according to the second embodiment is applied.

Hereinafter, the choke coil to which the second embodiment is applied will be described, however, in the following description, different points from the choke coil to which the first embodiment is applied will be mainly described and the description of the same matter will be omitted.

A choke coil 20 shown in FIG. 6 is obtained by embedding a conductive wire 22 molded into a coil shape inside a powder magnetic core 21. That is, the choke coil 20 is obtained by molding the conductive wire 22 with the powder magnetic core 21.

According to the choke coil 20 having such a configuration, a relatively small choke coil is easily obtained. When such a small choke coil 20 is produced, by using the powder magnetic core 21 having a high saturation magnetic flux density and a high magnetic permeability, and also having low loss, the choke coil 20 with low loss and low heat generation capable of coping with a large current despite its small size is obtained.

Further, since the conductive wire 22 is embedded inside the powder magnetic core 21, a gap is hardly generated between the conductive wire 22 and the powder magnetic core 21. According to this, vibration of the powder magnetic core 21 due to magnetostriction is suppressed, and thus, it is also possible to suppress the generation of noise accompanying this vibration.

When the choke coil 20 as described above is produced, first, the conductive wire 22 is disposed in a cavity of a molding die, and also the granulated powder containing the insulator-coated soft magnetic powder is packed in the cavity. That is, the granulated powder is packed therein so as to include the conductive wire 22.

Subsequently, the granulated powder is pressed together with the conductive wire 22, whereby a molded body is obtained.

Subsequently, in the same manner as in the above-mentioned first embodiment, the obtained molded body is subjected to a heat treatment. By doing this, the binding material is cured, whereby the powder magnetic core 21 and the choke coil 20 are obtained.

The powder magnetic core 21 may contain a soft magnetic powder other than the insulator-coated soft magnetic powder according to the above-mentioned embodiment as needed. In that case, the mixing ratio of the insulator-coated soft magnetic powder according to the embodiment and the other soft magnetic powder is not particularly limited and is arbitrarily set. Further, as the other soft magnetic powder, two or more types may be used.

Electronic Device

Next, an electronic device (an electronic device according to this embodiment) including the magnetic element according to this embodiment will be described in detail with reference to FIGS. 7 to 9.

Figure 7:
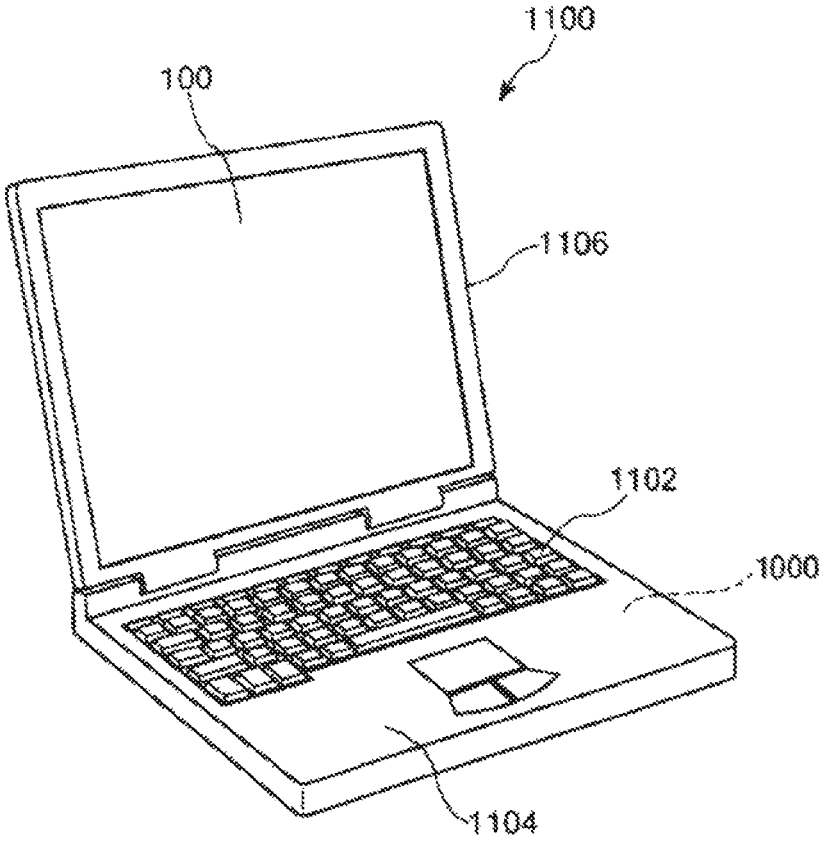
FIG. 7 is a perspective view showing a structure of a mobile (or notebook) personal computer to which an electronic device including the magnetic element according to the embodiment is applied.

FIG. 7 is a perspective view showing a structure of a mobile (or notebook) personal computer, to which the electronic device including the magnetic element according to this embodiment is applied. In this drawing, a personal computer 1100 includes a main body 1104 provided with a key board 1102, and a display unit 1106 provided with a display portion 100. The display unit 1106 is supported pivotably with respect to the main body 1104 via a hinge structure. Such a personal computer 1100 has, for example, a built-in magnetic element 1000 such as a choke coil, an inductor, or a motor for a switched-mode power supply.

Figure 8:
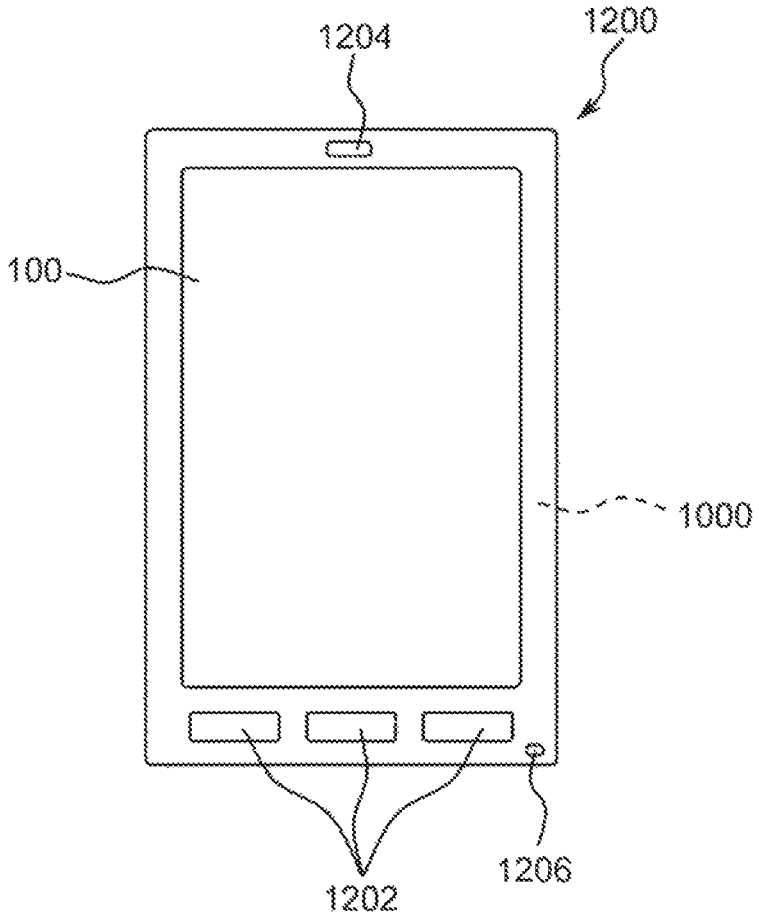
FIG. 8 is a plan view showing a structure of a smartphone to which an electronic device including the magnetic element according to the embodiment is applied.

FIG. 8 is a plan view showing a structure of a smartphone, to which the electronic device including the magnetic element according to this embodiment is applied. In this drawing, a smartphone 1200 includes a plurality of operation buttons 1202, an earpiece 1204, and a mouthpiece 1206, and a display portion 100 is placed between the operation buttons 1202 and the earpiece 1204. Such a smartphone 1200 has, for example, a built-in magnetic element 1000 such as an inductor, a noise filter, or a motor.

Figure 9:
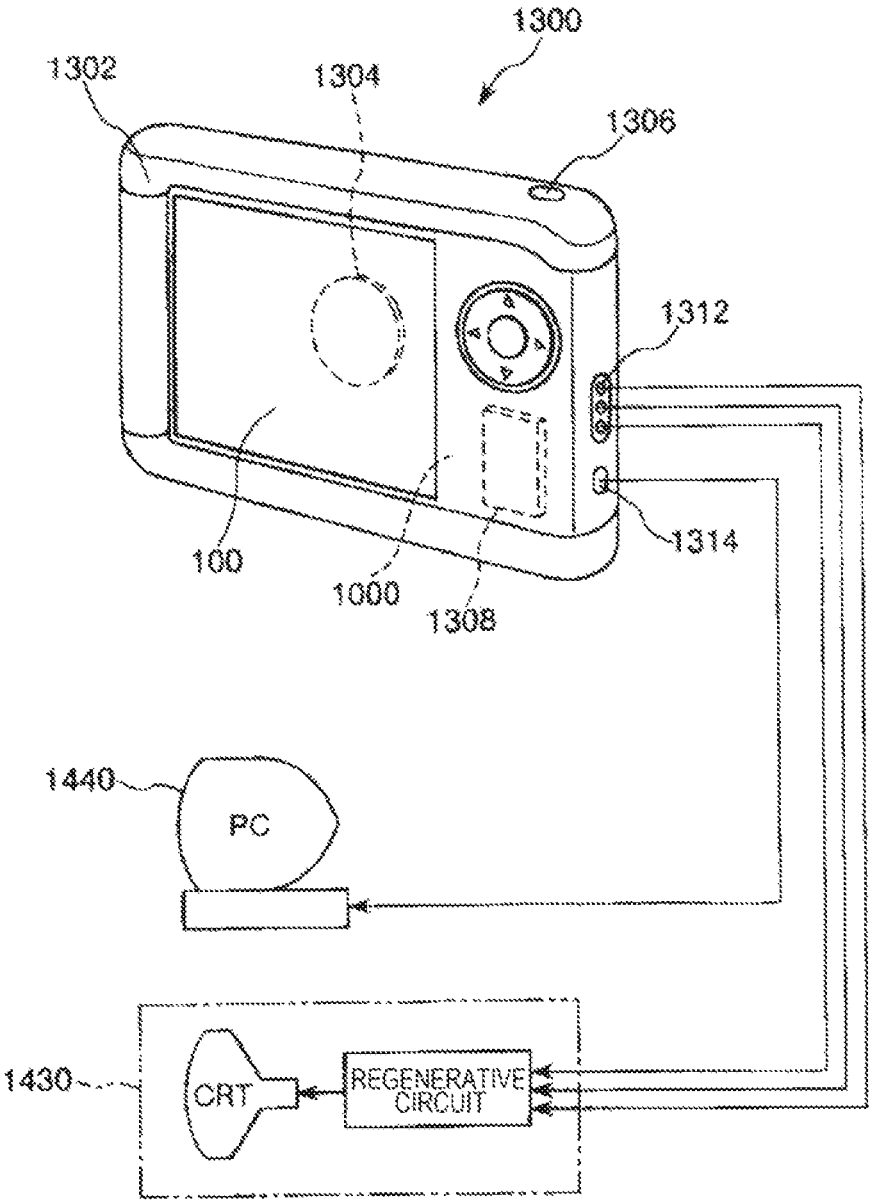
FIG. 9 is a perspective view showing a structure of a digital still camera to which an electronic device including the magnetic element according to the embodiment is applied.

FIG. 9 is a perspective view showing a structure of a digital still camera, to which the electronic device including the magnetic element according to this embodiment is applied. In this drawing, coupling to external devices is also briefly shown. A digital still camera 1300 generates an image capture signal (image signal) by photoelectrically converting an optical image of a subject by an image capture element such as a CCD (Charge Coupled Device).

On a back face of a case (body) 1302 in the digital still camera 1300, a display portion 100 is provided, and the display portion 100 is configured to display an image captured based on the image capture signal by the CCD. The display portion 100 functions as a finder configured to display a subject as an electronic image. Further, on a front side (on a rear side in the drawing) of the case 1302, a light receiving unit 1304 including an optical lens (an image capture optical system), a CCD, or the like is provided.

When a person who takes a picture confirms an image of a subject displayed on the display portion 100 and presses a shutter button 1306, an image capture signal of the CCD at that time is transferred and stored in a memory 1308. Further, a video signal output terminal 1312 and an input/output terminal 1314 for data communication are provided on a side face of the case 1302 in this digital still camera 1300. As shown in the drawing, a television monitor 1430 is coupled to the video signal output terminal 1312 and a personal computer 1440 is coupled to the input/output terminal 1314 for data communication as needed. Moreover, the digital still camera 1300 is configured such that the image capture signal stored in the memory 1308 is output to the television monitor 1430 or the personal computer 1440 by a predetermined operation. Also such a digital still camera 1300 includes a built-in magnetic element 1000 such as, for example, an inductor or a noise filter.

Such an electronic device includes the above-mentioned magnetic element, and therefore has excellent reliability even at a high temperature.

The electronic device according to this embodiment can also be applied to, for example, a cellular phone, a tablet terminal, a wearable terminal, a timepiece, an inkjet ejection device (for example, an inkjet printer), a laptop personal computer, a television, a video camera, a videotape recorder, a car navigation device, a pager, an electronic organizer (also including an electronic organizer having a communication function), an electronic dictionary, an electronic calculator, an electronic gaming machine, a word processor, a workstation, a videophone, a security television monitor, electronic binoculars, a POS terminal, medical devices (for example, an electronic thermometer, a blood pressure meter, a blood sugar meter, an electrocardiogram monitoring device, an ultrasound diagnostic device, and an electronic endoscope), a fish finder, various measurement devices, meters and gauges (for example, meters and gauges for vehicles, airplanes, and ships), vehicle control devices (for example, a control device for driving an automobile, etc.), a flight simulator, and the like other than the personal computer (mobile personal computer) shown in FIG. 7, the smartphone shown in FIG. 8, and the digital still camera shown in FIG. 9.

Vehicle

Next, a vehicle (a vehicle according to this embodiment) including the magnetic element according to this embodiment will be described with reference to FIG. 10.

Figure 10:
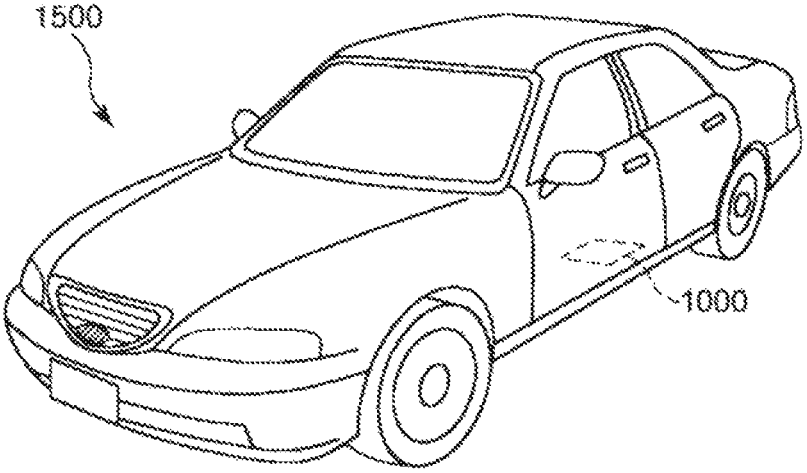
FIG. 10 is a perspective view showing an automobile to which a vehicle including the magnetic element according to the embodiment is applied.

FIG. 10 is a perspective view showing an automobile, to which the vehicle including the magnetic element according to the embodiment is applied.

An automobile 1500 has a built-in magnetic element 1000. Specifically, the magnetic element 1000 is built in, for example, electronic control units such as a car navigation system, an anti-lock brake system (ABS), an engine control unit, a power control unit for hybrid automobiles or electric automobiles, a car body posture control system, and a self-driving system, and various types of automobile components such as a driving motor, a generator, an air conditioning unit, and a battery.

Such a vehicle includes the above-mentioned magnetic element, and therefore has excellent reliability even at a high temperature.

The vehicle according to this embodiment can also be applied to, for example, a two-wheeled vehicle, a bicycle, an airplane, a helicopter, a drone, a ship, a submarine, a railroad car, a rocket, a spaceship, and the like other than the automobile shown in FIG. 10.

Hereinabove, the present disclosure has been described based on the preferred embodiments, but the present disclosure is not limited thereto, and the configuration of each portion may be replaced with an arbitrary configuration having the same function.

Further, in the present disclosure, an arbitrary structure may be added to the above-mentioned embodiment.

Further, in the above-mentioned embodiment, the powder magnetic core is described, as an application example of the insulator-coated soft magnetic powder according to the present disclosure. However, the application example is not limited thereto, and for example, the insulator-coated soft magnetic powder may be applied to a magnetic shielding sheet or a magnetic device including a green compact such as a magnetic head.

Further, the shapes of the powder magnetic core and the magnetic element are also not limited to those shown in the drawings and may be any shapes.

EXAMPLES

Next, specific examples of the present disclosure will be described.

1. Production of Insulator-Coated Soft Magnetic Powder

Example 1

First, a metal powder (core particles) of an Fe—Si—Cr-based alloy produced by a water atomization method was prepared. The average particle diameter of this metal powder was 10 μm.

On the other hand, a ceramic powder (insulating particles) of aluminum oxide was prepared. The average particle diameter of this powder was 18 nm.

Subsequently, the metal powder and the ceramic powder were fed into a friction mixer, and mechanical compression and friction actions were generated. By doing this, the ceramic powder was adhered to the surfaces of the metal particles.

Subsequently, the metal powder to which the ceramic powder was adhered was subjected to a heat treatment. By doing this, an insulator-coated soft magnetic powder was obtained. The heat treatment was performed by heating at a temperature of 1000° C. for 4 hours in a hydrogen atmosphere at a temperature increase rate of 5° C./min.

Examples 2 to 13

Insulator-coated soft magnetic powders were obtained in the same manner as in Example 1 except that the production conditions were changed as shown in Table 1 or 2, respectively.

In a hydrophobic treatment in Examples 2 and 5, a trimethylsilylating agent was used.

On the other hand, in a hydrophobic treatment in Example 7, an arylating agent (phenylating agent) was used.

Further, in Example 8, as the ceramic powder, a mixture of an aluminum oxide powder and a silicon oxide powder was used. The mixing ratio was set to 1:1 by volume ratio.

Examples 14 to 16

Insulator-coated soft magnetic powders were obtained in the same manner as in Example 1 except that a metal powder of an Fe—Cr—Al-based alloy produced by a water atomization method was used as the metal powder, and also the production conditions were changed as shown in Table 2, respectively.

Comparative Examples 1 and 2

Insulator-coated soft magnetic powders were obtained in the same manner as in Example 1 except that a metal powder of an Fe—Si—Cr-based alloy produced by a gas atomization method was used.

When the presence or absence of an oxide film was confirmed for the used metal powder, the presence of an oxide film was not confirmed.

Comparative Examples 3 and 4

Insulator-coated soft magnetic powders were obtained in the same manner as in Example 1 except that a glass powder composed of a glass component shown in Table 1 was used in place of the ceramic powder, respectively.

When the obtained insulator-coated soft magnetic powders were subjected to a heat treatment, the powders were aggregated, and the average particle diameter could not be measured.

Comparative Example 5

An insulator-coated soft magnetic powder was obtained in the same manner as in Example 1 except that the production conditions were changed as shown in Table 2.

Reference Example

An insulator-coated soft magnetic powder was obtained in the same manner as in Example 1 except that the formation of the insulating layer was omitted.

When the obtained insulator-coated soft magnetic powder was subjected to a heat treatment, the powder was aggregated, and the average particle diameter could not be measured.

2. Evaluation of Insulator-Coated Soft Magnetic Powder 2.1. Measurement of Average Particle Diameter Before and After Heat Treatment of Insulator-Coated Soft Magnetic Powder With respect to each of the insulator-coated soft magnetic powders obtained in the respective Examples, Comparative Examples, and Reference Example, the average particle diameter before and after heat treatment was measured.

Subsequently, the ratio of the average particle diameter after heat treatment to the average particle diameter before heat treatment was calculated.

The calculation results are shown in Tables 1 and 2.

2.2. Measurement of Coercive Force of Insulator-Coated Soft Magnetic Powder

With respect to each of the insulator-coated soft magnetic powders obtained in the respective Examples, Comparative Examples, and Reference Example, the coercive force was measured under the following measurement conditions.

Measurement Conditions for Coercive Force

Measurement device: magnetization measurement device (VSM system, TM-VSM 1230-MHHL, manufactured by Tamakawa Co., Ltd.)

Then, the measured coercive force was evaluated according to the following evaluation criteria.

Evaluation Criteria for Coercive Force

A: The coercive force is less than 3.0 Oe.

B: The coercive force is 3.0 Oe or more and less than 3.5 Oe.

C: The coercive force is 3.5 Oe or more and less than 5.0 Oe.

D: The coercive force is 5.0 Oe or more and less than 7.0 Oe.

E: The coercive force is 7.0 Oe or more and less than 10.0 Oe.

F: The coercive force is 10.0 Oe or more.

The evaluation results are shown in Tables 1 and 2.

2.3. Measurement of Electrical Breakdown Voltage of Insulator-Coated Soft Magnetic Powder 2 g of each of the insulator-coated soft magnetic powders obtained in the respective Examples, Comparative Examples, and Reference Example was packed in a cylindrical container made of alumina with an inner diameter of 8 mm. Then, electrodes made of brass were disposed on the upper and lower sides of the container.

Subsequently, a pressure of 40 kg/cm$^2$ was applied between the upper and lower electrodes using a digital force gauge.

Subsequently, while applying the load, a voltage of 50 V was applied between the upper and lower electrodes for 2 seconds at normal temperature (25° C.), and an electrical resistance between the electrodes was measured using a digital multimeter.

Subsequently, the voltage was increased to 100 V and applied for 2 seconds, and an electrical resistance between the electrodes was measured again.

Thereafter, an electrical resistance between the electrodes was repeatedly measured while increasing the voltage to 200 V, 250 V, 300 V, and so on, in increments of 50 V. The increase in the voltage and the measurement were repeated until an electrical breakdown occurred.

In a case in which an electrical breakdown did not occur even when the voltage was increased to 1000 V, the measurement was finished at that time point.

The above measurement was performed 3 times for each while changing the powder to a new one, and the smallest measurement value is shown in Tables 1 and 2.

2.4. Measurement of Packing Property of Insulator-Coated Soft Magnetic Powder

The apparent density of each of the insulator-coated soft magnetic powders obtained in the respective Examples, Comparative Examples, and Reference Example was measured.

The apparent density of the insulator-coated soft magnetic powder is determined in accordance with Metallic powders—Determination of apparent density specified in JIS Z 2504:2012, and the unit is g/cm$^3$.

Subsequently, the ratio of the apparent density to the true density of the insulator-coated soft magnetic powder was calculated and evaluated in light of the following evaluation criteria. Incidentally, the unit of the true density is g/cm$^3$.

Evaluation Criteria for Packing Property

A: 0.40 or more

B: 0.35 or more and less than 0.40

C: 0.30 or more and less than 0.35

D: less than 0.30

E: measurement cannot be performed due to sintering

The evaluation results are shown in Tables 1 and 2.

TABLE 1

| | | | unit | Example 1 | Example 2 | Example 3 | Example 4 | Example 5 | Example 6 | Example 7 | Example 8 | Example 9 |
|---|---|---|---|---|---|---|---|---|---|---|---|---|
| Production conditions for insulator-coated soft magnetic powder | Core particles | Type of base portion | — | | | | | Fe—Si—Cr | | | | |
| | | Oxide contained in oxide film | — | $SiO_2$ $Cr_2O_3$ | $SiO_2$ $Cr_2O_3$ | $SiO_2$ $Cr_2O_3$ | $SiO_2$ $Cr_2O_3$ | $SiO_2$ $Cr_2O_3$ | $SiO_2$ $Cr_2O_3$ | $SiO_2$ $Cr_2O_3$ | $SiO_2$ $Cr_2O_3$ | $SiO_2$ $Cr_2O_3$ |
| | | Thickness of oxide film | nm | 40 | 40 | 40 | 50 | 50 | 50 | 50 | 40 | 60 |
| | Insulating particles | Type of ceramic powder | — — | $Al_2O_3$ | $Al_2O_3$ | $Al_2O_3$ | $SiO_2$ | $SiO_2$ | $SiO_2$ | $SiO_2$ | $Al_2O_3$ $SiO_2$ | BN |
| | | Average particle diameter of ceramic powder | nm | 18 | 18 | 27 | 12 | 12 | 40 | 100 | 20 | 50 |
| | | Addition amount of ceramic powder | mass % | 0.85 | 0.68 | 0.85 | 0.59 | 0.59 | 0.59 | 0.59 | 0.50 | 0.54 |
| | | Surface treatment of ceramic powder | — | | hydrophobic treatment | | | hydrophobic treatment | | hydrophobic treatment | | |
| | Glass powder | Type of glass powder | — | | | | | | | | | |
| | | Average particle diameter of glass powder | μm | | | | | | | | | |
| | | Addition amount of glass powder | mass % | | | | | | | | | |
| | Ratio of average particle diameter after heat treatment to average particle diameter before heat treatment | | % | 101 | 102 | 103 | 106 | 105 | 107 | 108 | 100 | 99 |
| Evaluation results of insulator-coated soft magnetic powder | Coercive force | | — | A | B | A | B | B | B | A | A | B |
| | Electrical breakdown voltage | | V | 800 | 300 | 650 | 300 | 300 | 350 | 450 | 800 | 300 |
| | Apparent density/true density | | — | C | B | C | B | A | B | C | A | A |

| | | | unit | Example 10 | Example 11 | Comparative example 1 | Comparative example 2 | Comparative example 3 | Comparative example 4 | Reference example |
|---|---|---|---|---|---|---|---|---|---|---|
| Production conditions for insulator-coated soft magnetic powder | Core particles | Type of base portion | — | | | | Fe—Si—Cr | | | |
| | | Oxide contained in oxide film | — | $SiO_2$ $Cr_2O_3$ | $SiO_2$ $Cr_2O_3$ | | | $SiO_2$ $Cr_2O_3$ | $SiO_2$ $Cr_2O_3$ | $SiO_2$ $Cr_2O_3$ |
| | | Thickness of oxide film | nm | 60 | 60 | 0 | 0 | 40 | 40 | 40 |
| | Insulating particles | Type of ceramic powder | — — | BN | SiN | $Al_2O_3$ | $SiO_2$ | | | |
| | | Average particle diameter of ceramic powder | nm | 100 | 700 | 27 | 40 | | | |
| | | Addition amount of ceramic powder | mass % | 0.56 | 0.55 | 0.85 | 0.59 | | | |
| | | Surface treatment of ceramic powder | — | | | | | | | |
| | Glass powder | Type of glass powder | — | | | | | $P_2O_5$-based glass | $Bi_2O_3$-based glass | |
| | | Average particle diameter of glass powder | μm | | | | | 3.0 | 1.0 | |

TABLE 1-continued

| | | | | | | | | | |
|---|---|---|---|---|---|---|---|---|---|
| | Addition amount of glass powder | mass % | | | | | 0.76 | 2.24 | |
| | Ratio of average particle diameter after heat treatment to average particle diameter before heat treatment | % | 101 | 109 | 116 | 124 | — | — | — |
| Evaluation results of insulator-coated soft magnetic powder | Coercive force | — | B | B | B | B | B | B | B |
| | Electrical breakdown voltage | V | 300 | 300 | 200 | 100 | 150 | 200 | 0 |
| | Apparent density/true density | — | A | A | D | D | E | E | E |

TABLE 2

| | | | unit | Example 12 | Example 13 | Comparative example 5 | Example 14 | Example 15 | Example 16 |
|---|---|---|---|---|---|---|---|---|---|
| Production conditions for insulator-coated soft magnetic powder | Core particles | Type of base portion | — | | Fe—Si—Cr | | | Fe—Cr—Al | |
| | | Oxide contained in oxide film | — | $SiO_2$ $Cr_2O_3$ | $SiO_2$ $Cr_2O_3$ | $SiO_2$ $Cr_2O_3$ | $Cr_2O_3$ $Al_2O_3$ | $Cr_2O_3$ $Al_2O_3$ | $Cr_2O_3$ $Al_2O_3$ |
| | | Thickness of oxide film | nm | 40 | 40 | 40 | 50 | 50 | 50 |
| | Insulating particles | Type of ceramic powder | — — | $Al_2O_3$ | $ZrO_2$ | $Al_2O_3$ | $Al_2O_3$ | $Al_2O_3$ | $Al_2O_3$ |
| | | Average particle diameter of ceramic powder | nm | 18 | 18 | 18 | 18 | 18 | 18 |
| | | Addition amount of ceramic powder | mass % | 1.29 | 1.72 | 2.58 | 0.59 | 0.86 | 1.29 |
| | | Surface treatment of ceramic powder | — | | | | | | |
| | Glass powder | Type of glass powder | — | | | | | | |
| | | Average particle diameter of glass powder | μm | | | | | | |
| | | Addition amount of glass powder | mass % | | | | | | |
| | Ratio of average particle diameter after heat treatment to average particle diameter before heat treatment | | % | 103 | 105 | 115 | 101 | 103 | 104 |
| Evaluation results of insulator-coated soft magnetic powder | Coercive force | | — | A | A | A | A | A | A |
| | Electrical breakdown voltage | | V | 900 | 1000 | 1000 | 900 | 1000 | 1000 |
| | Apparent density/true density | | — | C | C | D | A | A | B |

As apparent from Tables 1 and 2, it was confirmed that the insulator-coated soft magnetic powders of the respective Examples showed favorable results for both the coercive force of the powder and the electrical breakdown voltage of the green compact as compared with the insulator-coated soft magnetic powders of the respective Comparative Examples and Reference Example. It was also confirmed that the insulator-coated soft magnetic powders of the respective Examples show a high ratio of the apparent density to the true density and therefore have a favorable packing property.

What is claimed is:

1. An insulator-coated soft magnetic powder, comprising:

a core particle including a base portion containing a soft magnetic material, and an oxide film that is provided on a surface of the base portion and contains an oxide of an element contained in the soft magnetic material; and an insulating particle that is provided on a surface of the core particle and has an insulating property, wherein the insulating particle contains at least one type of aluminum oxide, silicon oxide, zirconium oxide, and silicon nitride;

an average particle diameter after being subjected to a heat treatment of heating at 1000° C. is 90% or more and 110% or less of an average particle diameter before being subjected to the heat treatment; and the oxide film contains at least one type of silicon oxide, aluminum oxide, and chromium oxide.

2. The insulator-coated soft magnetic powder according to claim 1, wherein the oxide film has a thickness of 5 nm or more and 200 nm or less.

3. The insulator-coated soft magnetic powder according to claim 1, wherein the core particle has an average particle diameter of 1 μm or more and 50 μm or less.

4. A powder magnetic core, comprising the insulator-coated soft magnetic powder according to claim 1.

5. A magnetic element, comprising the powder magnetic core according to claim 4.

6. An electronic device, comprising the magnetic element according to claim 5.

7. A vehicle, comprising the magnetic element according to claim 5.

8. An insulator-coated soft magnetic powder, comprising:

a core particle including a base portion containing a soft magnetic material, and an oxide film that is provided on a surface of the base portion and contains an oxide of an element contained in the soft magnetic material; and an insulating particle that is provided on a surface of the core particle and has an insulating property, wherein the insulating particle contains at least one type of aluminum oxide, silicon oxide, zirconium oxide, and silicon nitride;

an average particle diameter after being subjected to a heat treatment of heating at 1000° C. is 90% or more and 110% or less of an average particle diameter before being subjected to the heat treatment; and the oxide film has a thickness of 5 nm or more and 200 nm or less.

9. The insulator-coated soft magnetic powder according to claim 8, wherein the oxide film contains at least one type of silicon oxide, aluminum oxide, and chromium oxide.

10. The insulator-coated soft magnetic powder according to claim 8, wherein the core particle has an average particle diameter of 1 μm or more and 50 μm or less.

11. A powder magnetic core, comprising the insulator-coated soft magnetic powder according to claim 8.

12. A magnetic element, comprising the powder magnetic core according to claim 11.

13. An electronic device, comprising the magnetic element according to claim 12.

14. A vehicle, comprising the magnetic element according to claim 12.

* * * * *